US005954549A

United States Patent [19]

Shinchi

[11] Patent Number: 5,954,549

[45] Date of Patent: Sep. 21, 1999

[54] ELECTRIC WIRE CONNECTION STRUCTURE

[75] Inventor: Akira Shinchi, Shizuoka-ken, Japan

[73] Assignee: Yazaki Corporation, Tokyo, Japan

[21] Appl. No.: 08/996,483

[22] Filed: Dec. 22, 1997

[30] Foreign Application Priority Data

Dec. 26, 1996 [JP] Japan ..... 8-348148

[51] Int. Cl.[6] ..... H01R 4/02

[52] U.S. Cl. ..... 439/874; 156/73.1

[58] Field of Search ..... 439/874, 736, 439/606, 604, 466, 465, 467; 156/73.1, 73.2, 73.4

[56] References Cited

U.S. PATENT DOCUMENTS 5,641,307 6/1997 Gerrans ..... 439/606

FOREIGN PATENT DOCUMENTS 7-70345 7/1995 Japan .

*Primary Examiner*—Paula Bradley
*Assistant Examiner*—Antoine Ngandjui
*Attorney, Agent, or Firm*—Finnegan, Henderson, Farabow, Garrett & Dunner, L.L.P.

[57] ABSTRACT

A terminal and a covered electric wire are pressed by a groove portion of a first member and a protruding portion of a second member, after which ultrasonic vibration is applied to bring the terminal and the covered electric wire into electric conduction therebetween, thereby ensuring the connection therebetween. A block portion is provided in the groove portion of the first member and the protruding portion which is to be fitted into the groove portion is provided with respect to the second member. The block portion and the protruding portion are each made of resin having a smaller coefficient of linear expansion, thereby making small the amount of shrinkage resulting from natural cooling after application of ultrasonic vibration and thereby ensuring the contact pressure of the terminal with core wires of the covered electric wire.

3 Claims, 5 Drawing Sheets

ELECTRIC WIRE CONNECTION STRUCTURE

BACKGROUND OF THE INVENTION

1. Field of the Invention

The present invention relates to an electric wire connection structure adapted to connect a covered electric wire to a terminal and simultaneously assemble a housing having these members accommodated therein by the use of ultrasonic waves.

2. Description of Relevant Art

There is disclosed in Japanese Patent Publication No. 7-70345 a technique of applying ultrasonic vibration as a conventional technique for bringing a core wire of a covered electric wire and a terminal into mutual electric conduction therebetween as they are without uncovering an insulating covering thereof and simultaneously performing this electric conduction and the assembly of a relevant housing.

FIGS. 1A and 1B show a connector which is manufactured by this conventional technique and a first member 1 and a second member 2 each moded by resin oppose each other.

In an upper surface of the first member 1 there are longitudinally formed groove portions 3, and small concave portions 4 are formed in the longitudinal direction of the groove portion 3 at suitable intervals. Into the groove portion 3 of the first member 1 there is inserted in the longitudinal direction a terminal 5 on which a covered electric wire 6 is placed. The covered electric wire 6 is placed on the terminal 5 in a state where a number of core wires are covered by an insulating covering.

On an underside of the second member 2 there are longitudinally formed protruding portions 7 which are to be fitted into the groove portions 3 of the first member 1, and there are also formed small convex portions 8 which are to be fitted into the concave portions 4 of the groove portion 3.

This structure is assembled as follows. In a state where the terminal 5 and the covered electric wire 6 have been inserted into the groove portion 3, the protruding portion 7 of the second member 2 is fitted into the groove portion 3 of the first member 1, whereby the terminal 5 and the covered electric wire 6 are pressed by the second member 2 and the first member 1. At this time, at the portions wherein the concave portions 4 and the convex portions 8 are interfitted, the terminal 5 is partially bent to thereby prevent the terminal 5 and the covered electric wire 6 from being drawn off.

And, with the first member 1 and the second member 2 being clamped, ultrasonic vibration is applied from a horn (not shown). By the heat generated due to the vertical vibration applied by application of ultrasonic vibration, an insulating covering of the covered electric wire 6 is molten and splashed and thereby removed, with the result that a core wire of the covered electric wire 6 and the terminal 5 are brought into electric conduction therebetween. Simultaneously with this electric conduction, the first member 1 and the second member 2 are welded and integrated together, with the result that there is formed a housing having the terminal 5 and the electric wire accommodated therein, whereby a connector can be manufactured.

FIG. 2 shows a conventional structure for manufacturing a connector. A plurality of groove portions 3 are formed in a first member 1 and a plurality of protruding portions 7 which oppose the groove portions 3 are formed on a second member 2. And, a terminal is accommodated in each groove 3 and a covered electric wire is placed on this terminal, after which the resulting laminate is pressed by the first member 1 and the second member 2 and ultrasonic vibration is applied to the resulting structure in the identical way as mentioned above to thereby provide a connector.

However, the conventional structure involves therein the problem that contact between the terminal and the covered electric wire is likely to become insufficient. FIG. 3 is a section illustrating this. When connecting the terminal 5 and the core wire 9 of the covered electric wire 6 to each other, the heat generated due to the application of ultrasonic vibration causes thermal expansion of the protruding portion 7 of the second member 2 and a bottom wall portion 10 of the groove portion 3 of the first member 1. However, in natural cooling after the connection, the protruding portion 7 shrinks in a direction indicated by an arrow A and the bottom wall portion 10 of the groove portion 3 shrinks in a direction indicated by an arrow B which is opposite to the direction indicated by the arrow A. Due to this shrinkage made in the mutually opposite directions, the pressure of contact of the core wire 9 with the terminal 5 becomes low with the result that excellent contact between the core wire 9 and the terminal 5 becomes impossible with the result that the electric conduction between the two becomes defective and thus the reliability of the connection becomes low.

Such being the case, it is considered to form the first member 1 and the second member 2 by the use of the resin having a small coefficient of linear expansion which is less expanded and shrunk. However, that resin is less expanded and shrunk necessarily means that the shrinkage of resin is small at the time of molding thereof. Therefore, after the molding, the releasability thereof from the mold is inferior. For this reason, the molding of a member having the groove portions and protruding portions 7 which is of a configuration having a significantly large depth becomes difficult and therefore this technique is not practical. Besides, the resin having a small coefficient of linear expansion is expensive, which causes remarkable increase in cost of the completed product.

SUMMARY OF THE INVENTION

The present invention has been achieved with such points in view.

It therefore is an object of the present invention to provide an electric wire connection structure which enables reliable connection and also enables excellent molding thereof by reliably preventing defective conduction attributable to cooling.

To achieve the object, a first aspect of the invention provides an electric wire connection structure so arranged that the terminal is accommodated in the groove portion of a rectangular cross section formed in the first member made of resin; and the covered electric wire is placed on this terminal, whereby by applying ultrasonic vibration while pressing the covered electric wire against the terminal by the second member made of resin and having the protruding portions closing the groove portions, the core wire of the covered electric wire and the terminal are brought into electric conduction therebetween, wherein at least one of the groove portion and the protruding portion is made of resin having a coefficient of linear expansion smaller than that of the welded portion between the first member and the second member.

According to the first aspect, the protruding portion of the second member closes the groove portion of the first member and, by applying ultrasonic vibration with the second member being kept pressing the covered electric wire, the insulating covering of the covered electric wire is molten, with the result that the core wire therewithin contacts with the terminal, whereby the both are brought into electric conduction therebetween. Besides, simultaneously with this electric conduction, the first member and the second member are welded and integrated together by application of ultrasonic vibration, to thereby provide a connector equipped with the terminal and the covered electric wire.

Although the protruding portion and the groove portion are expanded by the heat generated by application of ultrasonic vibration, since either one of the protruding portion and the groove portion is formed using resin having a smaller coefficient of linear expansion, at the time of natural cooling after connection made between the first member and the second member the portion made of resin having a smaller coefficient of linear expansion is less in amount of shrinkage, with the result that the pressure contact between the core wire and the terminal occurs due to the protruding portion and the groove portion. This can ensure the electric conduction between the core wire and the terminal.

In this structure, resin having a smaller coefficient of linear expansion is only used in a part of the first member or the second member and so the first member or the second member is for the most part made of ordinary resin. Therefore, a necessary amount of molding shrinkage can be ensured and in addition the releasability of resin from the mold does not deteriorate, with the result that the first member or the second member can be reliably formed into a configuration of a significantly large depth.

A second aspect of the invention provides an electric wire connection structure wherein there are formed engaging portions which are engaged with the resin smaller in coefficient of linear expansion and the resin at the welded portion in directions substantially identical as that of pressing the second member.

According to the second aspect, in the structure wherein the resin having a smaller coefficient of linear expansion and the resin at the welded portion are engaged with each other along the direction of pressing the second member, a sufficient amount of resin having a smaller coefficient of linear expansion can be ensured in the direction of pressing the second member, i.e., in the direction of contact between the terminal and the core wire. For this reason, it is possible to further reliably ensure the contact between the terminal and the core wire.

A third aspect of the invention provides an electric wire connection structure wherein there are formed engaging portions which are engaged with the resin smaller in coefficient of linear expansion and the resin at the welded portion in directions substantially perpendicular to that of pressing the second member.

According to the third aspect, as by their engagement made in directions substantially perpendicular to the direction of pressing the second member the resin having a smaller coefficient of linear expansion and the resin at the welded portion are reliably engaged with each other, even when the resin having a smaller coefficient of linear expansion is shrunk, there is no likelihood that the both resins will be separated from each other.

Accordingly, the assembling reliability is enhanced.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1A:
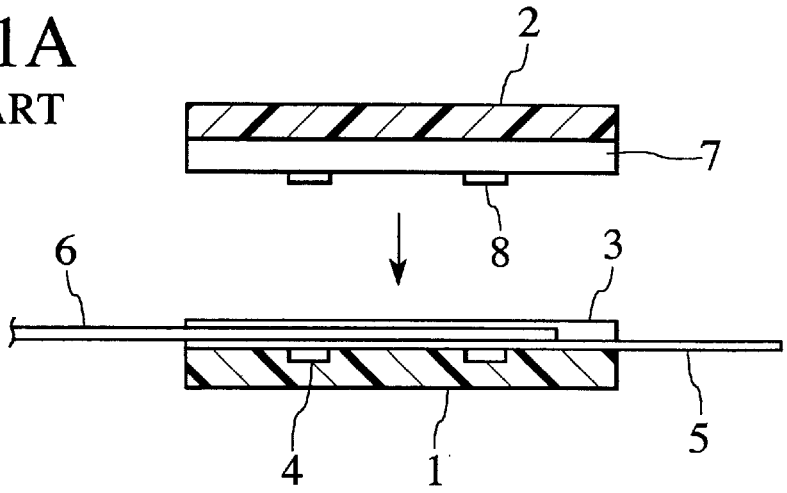
FIG. 1A PRIOR ART
FIG. 1A is a section of a conventional connection structure and FIG. 1B is a front view thereof.
Figure 1B:
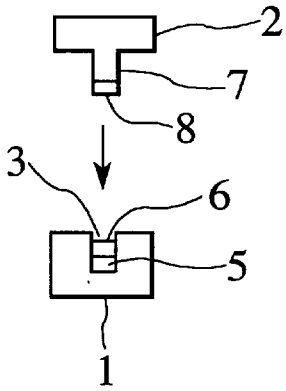
FIG. 1B PRIOR ART
Figure 2:
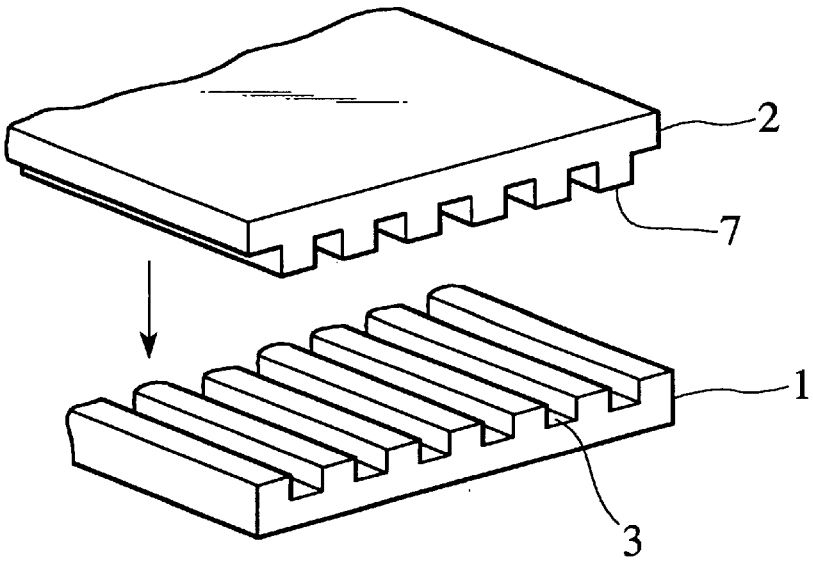
FIG. 2 PRIOR ART
FIG. 2 is an exploded perspective view of another conventional connection structure.
Figure 3:
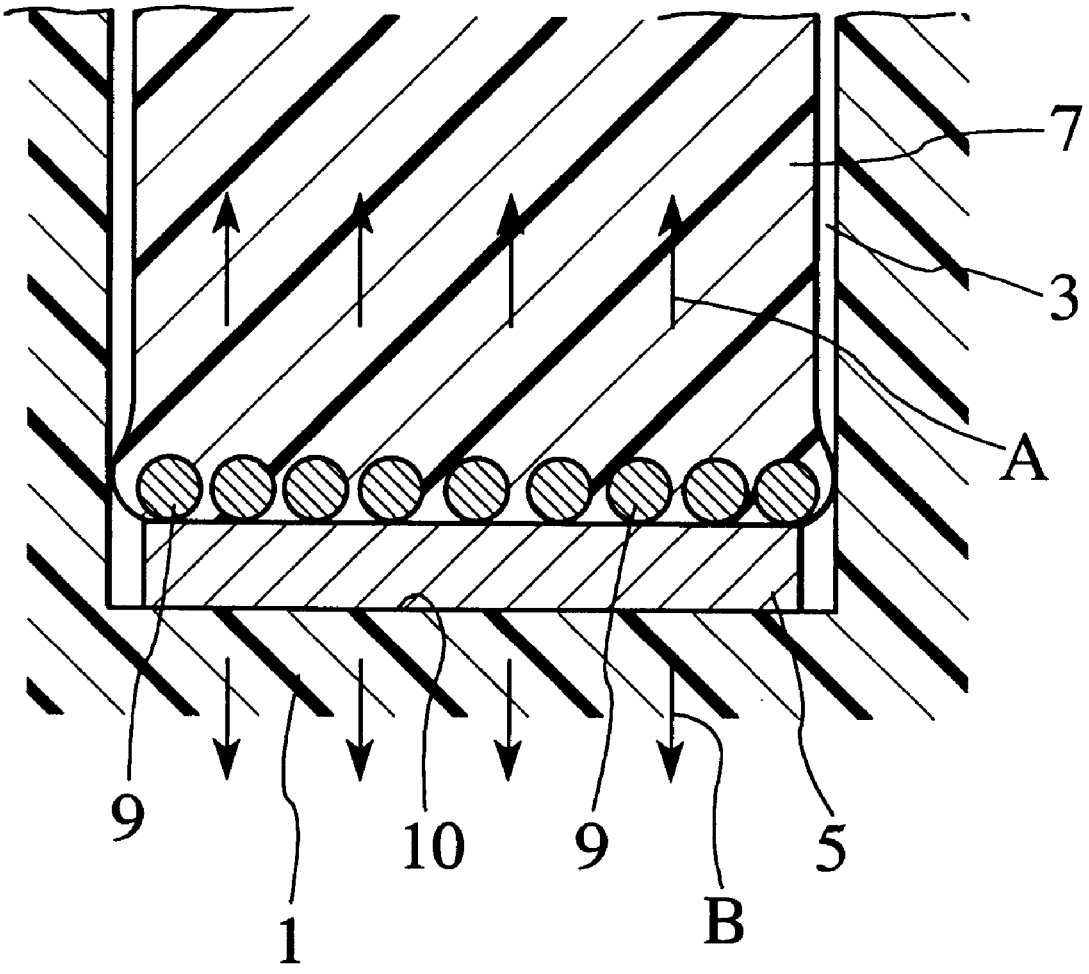
FIG. 3 PRIOR ART
FIG. 3 is a section illustrating conventional problems.

The contents of U.S. Pat. No. 5,584,122 are incorporated herein by reference.

There will be detailed below the preferred embodiments of the present invention with reference to the accompanying drawings. Like members are designated by like reference characters.

Figure 4:
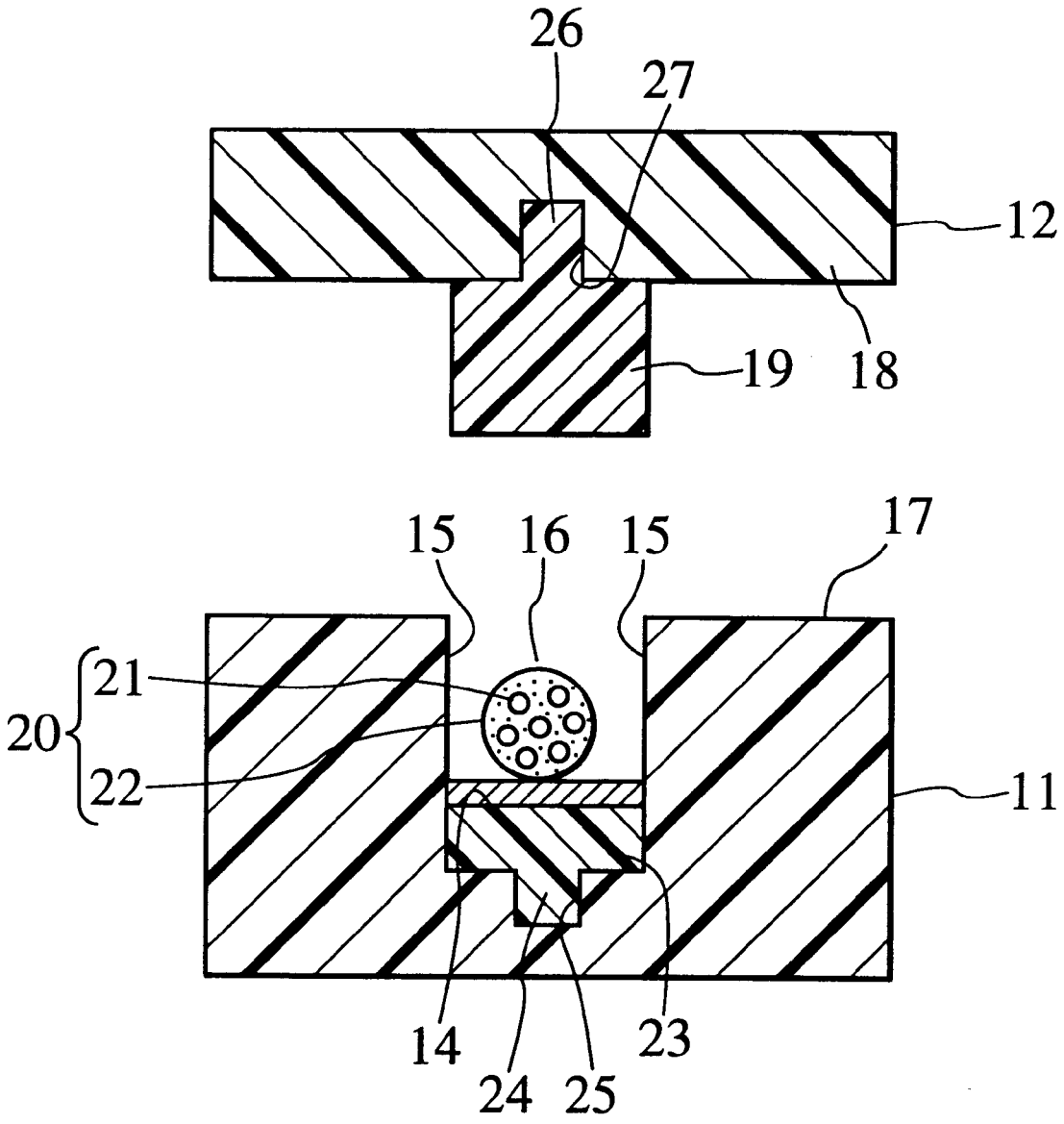
FIG. 4 is a section of an embodiment of the present invention.

FIG. 4 is a section of an embodiment of the present invention, comprising a first member 11 made of resin, a second member 12 made of resin and a terminal 13 made of conductive metal.

In the first member 11 there is formed an upwardly open groove portion 16 of a rectangular cross section surrounded by a bottom wall portion 14 made lower in level than the surrounding area and side wall portions 15 extending upright from both sides of the bottom wall portion 14. The groove portion 16 extends in a direction of its piercing through the drawing sheet and the terminal 13 is placed on the bottom wall portion 14 of the groove portion 16. The portion surrounding the groove portion 16 becomes a main body portion 17 welded to the second member 12.

The second member 12 has a main body portion 18 abutting against an upper surface of the first member 11 and contacting therewith. This main body portion 18 is welded to the main body portion 17 of the first member 11 by application of ultrasonic vibration thereto.

Also, the portion of the second member 12 which opposes the groove portion 16 has a protruding portion 19 provided thereon in the form of its protruding therefrom. The protruding portion 19 is formed into a configuration of substantially identical rectangular cross section as that of the groove portion 16 of the first member 11, and this protruding portion 19 is fitted into the groove portion 16 to thereby close this groove portion 16.

The terminal 13 is in the shape of a flat plate and this terminal 13 and a covered electric wire 20 are connected to each other. The covered electric wire 20 is prepared by covering a plurality of core wires 21 each consisting of conductive metal by means of an insulating covering 22 and this covered electric wire is served for being connected to the terminal 13 in a state of its being covered with this insulating covering 22. The covered electric wire 20 is placed on the terminal 13, after which the protruding portion 19 of the second member 12 is pressed from above this placed covered electric wire 20 onto this electric wire 20.

In this embodiment, a block portion 23 made of resin is provided in the groove portion 16 of the first member 12. The block portion 23 is made of resin different from that constituting the main body portion 17 of the first member 11 and is provided in the groove portion 16 by dichroic formation of resin, post-molding fitting or the like. This block portion 23 has its upper surface made to serve as the bottom wall portion 14 of the groove portion 16 by having a prescribed thickness. Also, the block portion 23 has integrally on an underside thereof an engaging convex portion 24 of a small width which extends in the direction of pressing the second member. And this engaging convex portion 24 is engaged with an engaging concave portion 25 of the main body portion 17.

Further, in the second member 12, the protruding portion 19 is made of resin different from the resin constituting the main body portion 18 and is made integral with the main body portion 18 by dichroic formation of resin, post-molding fitting or the like the same as that mentioned above. This protruding portion 19 also has an engaging convex portion 26 of a small width extending in a direction opposite to that of the extension of the engaging convex portion 24 and this engaging convex portion 26 is engaged with an engaging concave portion 27 of the main body portion 18.

The above-mentioned block portion 23 and protruding portion 19 are each molded using resin smaller in coefficient of linear expansion than the resin constituting each of the main body portions 17, 18. As a result of this, the block portion 23 and the protruding portion 19 are each smaller than the main body portion 17, 18 in amount of expansion and shrinkage resulting from a change in temperature. As the resin used of the block portion 23 and the protruding portion 19 when the resin of the main body portions 17, 18 is PBT or HPA, there can be selected, for example, PEI, SPS or PBT.

When assembling the above-described structure, the terminal 13 is accommodated in the groove portion 16 of the first member 11 and the covered electric wire 20 is placed on the terminal 13. And, the second member 12 is superposed on the resulting first member 11 so that the protruding portion 19 may be fitted into the groove portion 16, thereby pressing the covered electric wire against the terminal by means of the second member 12. Utrasonic vibration is applied by a horn (not shown) while this pressing is being performed. Heat is generated by application of ultrasonic waves and by this heat the insulating covering 22 is molten and removed with the result that the core wires 21 are exposed.

The exposed core wires 21 are released from a bundled state by the ultrasonic waves, with the result that respective ones of the core wires 21 are contacted with the terminal 13, whereby the terminal 13 and the covered electric wire 20 are brought into electric conduction therebetween. Simultaneously with this electric conduction, the respective main body portions 17, 18 of the first member 11 and the second member 12 are welded together and integrated together.

The above-mentioned contact between the terminal 13 and the core wires 21 is performed due to the thermal expansion of the first member 11 and the second member 12 and this expansion shrinks by thereafter leaving the structure to stand as is. In this case, the resins by which the contact between the terminal 13 and the core wires 21 is performed, i.e., the block portion 23 and the protruding portion 19 each have a smaller coefficient of linear expansion and therefore are each small in amount of shrinkage. For this reason, even after natural cooling, the block portion 23 and the protruding portion 19 can maintain the contacted state of the terminal 13 and the core wires 21 as is, thereby ensuring a reliable electric conduction therebetween.

In this embodiment, the whole of each of the first member 11 and the second member 12 is not made of resin having a smaller coefficient of linear expansion but respective parts thereof, i.e., the block portion 23 and the protruding portion 19 are each made of resin having a smaller coefficient of linear expansion and the main body portions 17, 18 thereof are each made of ordinary resin. Therefore, it is possible to ensure an amount of formation shrinkage of each of the first member 11 and the second member 12 as a whole, with the result that the releasability of the resin from the mold does not deteriorate, with the result that the first member 11 and the second member 12 can be reliably molded even when each of them is formed having a configuration of a significantly large depth such as the protruding portion, groove portion or the like and in addition can be manufactured inexpensively.

Further, in this embodiment, the block portion 23 and the protruding portion 19 are respectively engaged with the main body portions 17, 18 in the identical direction as the direction of pressing the second member 12. Therefore, the amount of resin in each of these portions as viewed in the pressing direction, i.e., in the contacting direction of the terminal 13 with the core wires 21 becomes sufficient, with the result that the contact of the terminal with the core wires can be more reliably ensured.

Figure 5:
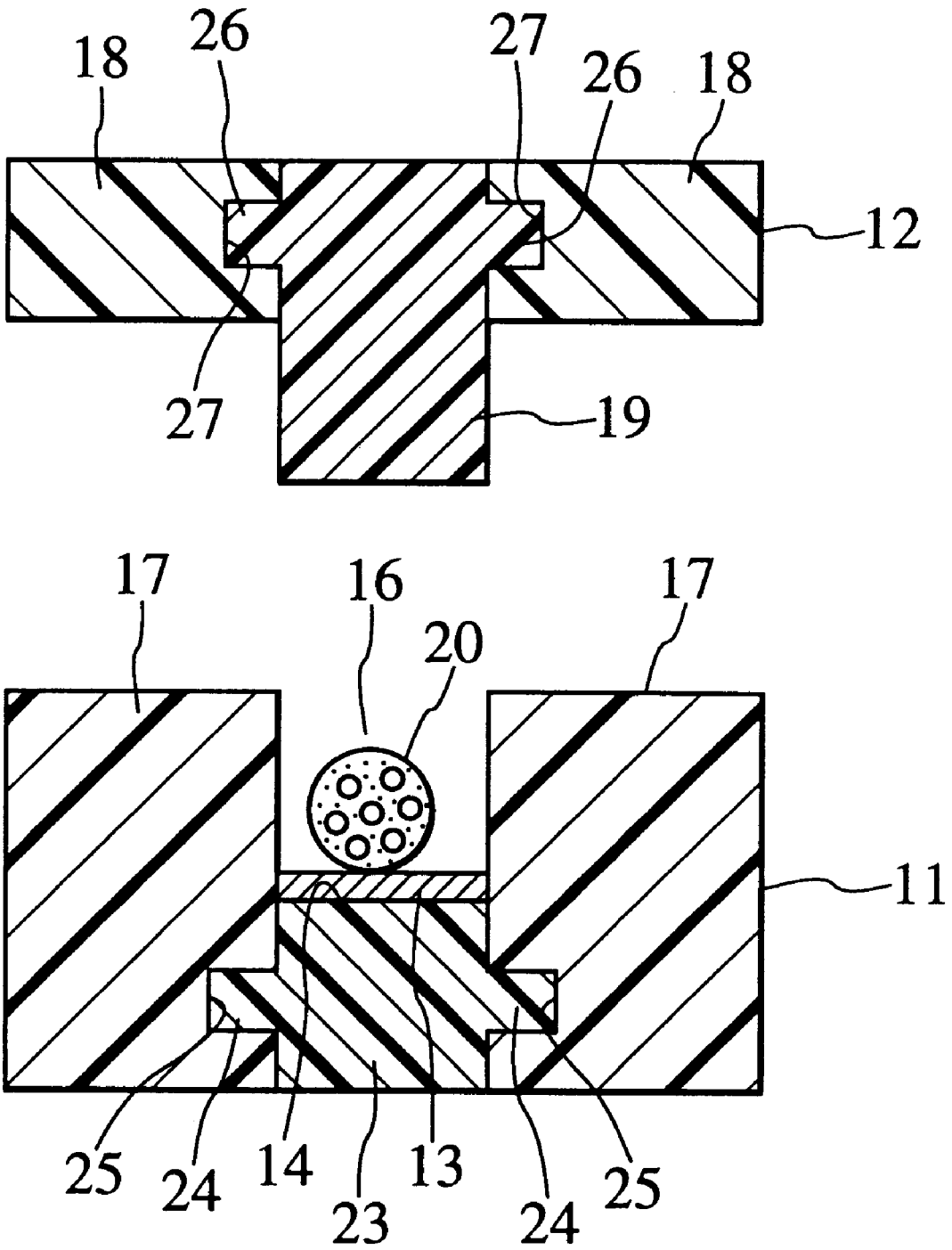
FIG. 5 is a section of another embodiment of the present invention.

FIG. 5 is a section of another embodiment of the present invention, in which a first member 11 is constituted by a block portion 23 and main body portions 17 on both sides of the block portion 23. The main body portion 17 is made higher in level than the block portion 23, whereby a groove portion 16 is formed by the block portion 23 and the main body portions 17 on both sides and an upper surface of the block portion 23 serves as a bottom wall portion 14 of the groove portion 16. Also, on the block portion 23 there are formed engaging convex portions 24 each of a small width so that these engaging convex portions may extend laterally from both side surfaces. This engaging convex portion 24 is engaged with the engaging concave portion 25 of each main body portion 17.

On the other hand, the second member 12 also is formed by the protruding portion 19 and main body portions 18 on both sides thereof. In this second member 12 also, there are formed at both side surfaces of the protruding portion 19 engaging convex portions 26 each of a small width extending in the identical direction as in the case of the engaging convex portions 24 and these engaging convex portions 26 are engaged with engaging concave portions 27 of the main body portion 18 on both side surfaces of the protruding portion 19.

In this embodiment also, the block portion 23 and the protruding portion 19 are formed using resin having a smaller coefficient of linear expansion as compared with the resin constituting each of the main body portions 17, 18. Accordingly, as in the case of the above-mentioned embodiment, it is possible to ensure the electric conduction between the terminal 13 and the core wires 21 after application of the ultrasonic vibration. Also, engagement of the block portion 23 with the main body portion 17 and engagement of the protruding portion 19 with the main body portion 18 are made in directions intersecting the direction of pressing the second member 12, i.e., in directions intersecting the contacting direction of the terminal 13 with the core wires 21, and therefore the block portion 23 and the protruding portion 19 are reliably engaged with the main body portions 17, 18. For this reason, even when the amount of shrinkage differs between the corresponding portions, the block portion 23 and the protruding portion 19 are respectively prevented from being separated from the main body portions 17 and 18, thus the assembled state becomes stabilized.

Figure 6:
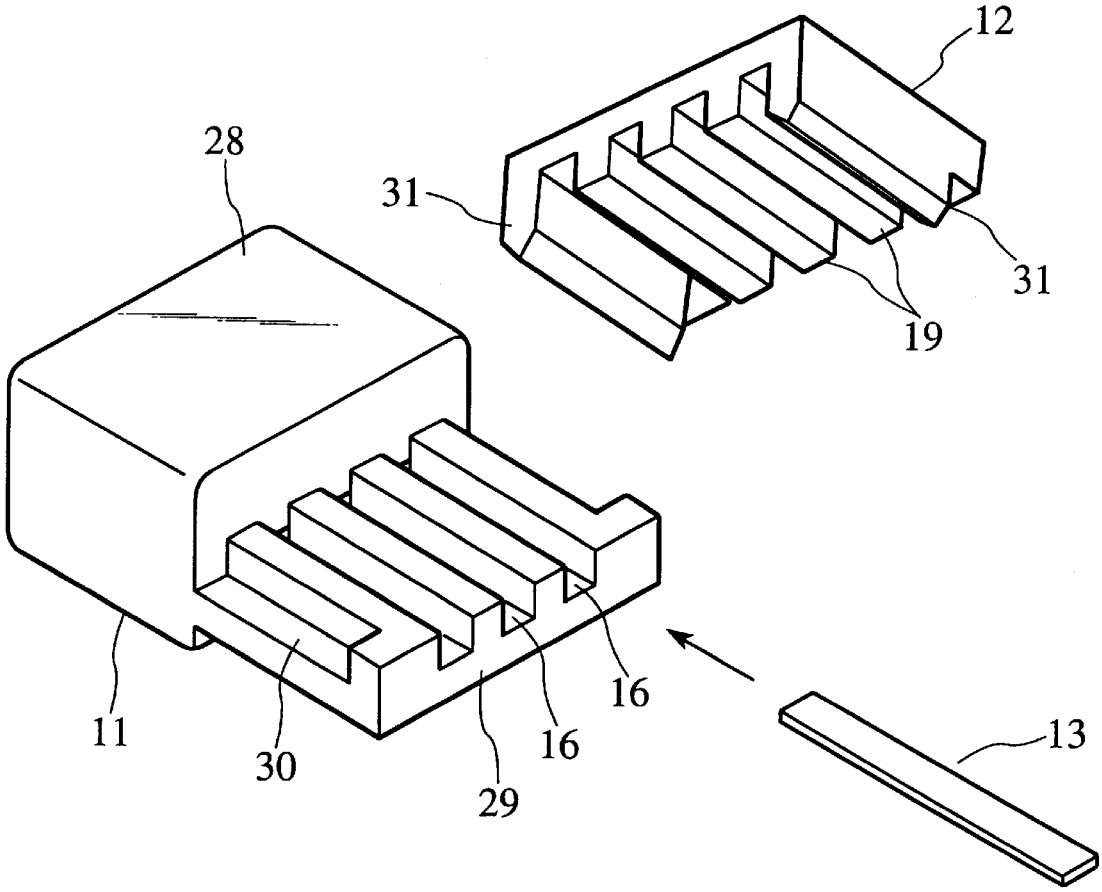
FIG. 6 is an exploded perspective view of a connector of a multi-polar connection to which the present invention is applied.

FIG. 6 is an exploded perspective view of a connector of a multi-polar connection to which the above-mentioned embodiment has been applied. The first member 11 becomes a connector housing to which a mating connector (not shown) is connected by interfitting or the like. This first member 11 is comprised of a housing main body 28 to which a mating connector is connected and an electric wire retaining portion 29 which extends from one side of the housing main body 28. In the electric wire retaining portion 29 there are formed longitudinally thereof in parallel with one another a plurality of groove portions 16 open at its upper zone and each of a rectangular cross section.

In contrast to this, the second member 12 constitutes a cover member which is to be mounted on the upper surface of the electric wire retaining portion 29 and on this second member 12 there are formed at positions corresponding to the groove portions 16 a plurality of protruding portions 19 closing the groove portions 16 by their being fitted with respect thereto. In this case, on both side portions of the second member there are provided abutting portions 31 abutting against recessed portions 30 of both side portions of the electric wire retaining portion 29 so that these abutting portions 31 may facilitate the welding by being so formed as to sharpen at forward ends thereof respectively.

A terminal 13 is formed in the shape of a flat plate and is inserted into the groove portion 16 of the first member. And, an inserted forward end portion thereof is led out into the housing main body 28 and is electrically connected to a terminal extended from a mating connector. On this terminal 13 there is placed a covered electric wire (not shown) and, in a state where the terminal 13 is pressed by the second member 12, ultrasonic vibration is applied thereto, whereby the terminal 13 is brought into electric conduction with core wires of the covered electric wire.

By applying the above-mentioned embodiment to this connector, it is possible to provide a connector of a reliable multi-polar connection structure.

Incidentally, in the present invention, even when resin of a smaller coefficient of linear expansion is used with respect to either the groove portion or the protruding portion, it is possible to provide a similar reliable connection and also to obtain excellent molding.

While preferred embodiments of the present invention have been described using specific terms, such description is for illustrative purposes, and it is to be understood that changes and variations may be made without departing from the spirit or scope of the following claims.

What is claimed is:

1. An electric wire connection structure comprising:

a first member having a first main body portion and a groove portion and made of resin;

a terminal accommodated within the groove portion;

a covered electric wire placed on the terminal; and a second member having a second main body portion and a protrusion positioned in the groove portion and made of a resin, whereby a core wire of the electric wire and the terminal are conductively joined by applying ultrasonic vibrations while pressing the covered electric wire against the terminal, and wherein at least one of the groove portion and the protrusion is formed by a resin having a smaller coefficient of linear expansion than the resins of the first and second main body portions of the first and second members.

2. An electric wire connection structure according to claim 1, wherein there are formed engaging portions which are engaged with the resin having a smaller coefficient of linear expansion and the resins of the first and second main body portions of the first and second members in directions substantially identical to that of the pressing of the second member.

3. An electric wire connection structure according to claim 1, wherein there are formed engaging portions which are engaged with the resin having a smaller coefficient of linear expansion and the resins of the first and second main body portions of the first and second members in directions crossing that of pressing the second member.

* * * * *